US012312645B2

(12) United States Patent
Okushiro et al.

(10) Patent No.: US 12,312,645 B2
(45) Date of Patent: May 27, 2025

(54) RAIL AND MANUFACTURING METHOD THEREFOR

(71) Applicant: JFE STEEL CORPORATION, Tokyo (JP)

(72) Inventors: Kenji Okushiro, Tokyo (JP); Kazuya Tokunaga, Tokyo (JP); Moriyasu Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 403 days.

(21) Appl. No.: 17/596,437

(22) PCT Filed: Jun. 9, 2020

(86) PCT No.: PCT/JP2020/022743

§ 371 (c)(1),
(2) Date: Dec. 10, 2021

(87) PCT Pub. No.: WO2020/255806

PCT Pub. Date: Dec. 24, 2020

(65) Prior Publication Data

US 2022/0307101 A1 Sep. 29, 2022

(30) Foreign Application Priority Data

Jun. 20, 2019 (JP) ..... 2019-114890

(51) Int. Cl.
*C21D 8/06* (2006.01)
*C21D 11/00* (2006.01)
(Continued)

(52) U.S. Cl.
CPC ..... *C21D 8/065* (2013.01); *C21D 11/005* (2013.01); *C22C 38/02* (2013.01); *C22C 38/04* (2013.01);
(Continued)

(58) Field of Classification Search
CPC ..... C21D 9/04; C22C 38/001; C22C 38/02; C22C 38/04; C22C 38/12; C22C 38/14
See application file for complete search history.

(56) References Cited

U.S. PATENT DOCUMENTS 4,486,248 A * 12/1984 Ackert ..... C21D 9/04 148/581
7,972,451 B2 7/2011 Masaharu et al.
(Continued)

FOREIGN PATENT DOCUMENTS

CN 102137947 A 7/2011
CN 102985574 A 3/2013
(Continued)

OTHER PUBLICATIONS

Mar. 25, 2022, Office Action issued by the China National Intellectual Property Administration in the corresponding Chinese Patent Application No. 202080043914.X with English language search report.
(Continued)

*Primary Examiner* — Jie Yang
(74) *Attorney, Agent, or Firm* — KENJA IP LAW PC

(57) ABSTRACT

A rail comprises a predetermined chemical composition. In a hardness distribution in a region from a rail head surface to a depth of 16.0 mm, a part having higher hardness than V1 that is minimum hardness in a first internal region is present in a second internal region, and hardness of the rail head surface is HBW 400 to 520 and average hardness in the region from the rail head surface to the depth of 16.0 mm is HBW 350 or more.

18 Claims, 4 Drawing Sheets

(51) Int. Cl.

| | |
|---|---|
| ***C22C 38/02*** | (2006.01) |
| ***C22C 38/04*** | (2006.01) |
| ***C22C 38/18*** | (2006.01) |

(52) U.S. Cl.

CPC ..... *C22C 38/18* (2013.01); *C21D 2211/001* (2013.01); *C21D 2211/002* (2013.01); *C21D 2211/009* (2013.01)

(56) References Cited

U.S. PATENT DOCUMENTS

| | | | | |
|---|---|---|---|---|
| 8,980,019 | B2 | 3/2015 | Masaharu et al. | |
| 9,476,107 | B2 | 10/2016 | Bramfitt et al. | |
| 10,253,397 | B2 | 4/2019 | Kimura et al. | |
| 10,563,357 | B2 | 2/2020 | Ueda et al. | |
| 2007/0181231 | A1* | 8/2007 | Ueda | C21D 9/04 148/584 |
| 2011/0155821 | A1 | 6/2011 | Masaharu et al. | |
| 2012/0298263 | A1* | 11/2012 | Bramfitt | C22C 38/12 148/320 |
| 2013/0065079 | A1 | 3/2013 | Masaharu et al. | |
| 2014/0246130 | A1 | 9/2014 | Bramfitt et al. | |
| 2016/0083820 | A1 | 3/2016 | Kimura et al. | |
| 2017/0349986 | A1 | 12/2017 | Froman et al. | |
| 2018/0112284 | A1* | 4/2018 | Bramfitt | C22C 38/24 |

FOREIGN PATENT DOCUMENTS

| | | | |
|---|---|---|---|
| CN | 104884645 | A | 9/2015 |
| CN | 105051220 | A | 11/2015 |
| JP | H09241747 | A | 9/1997 |
| JP | 2000178690 | A | 6/2000 |
| JP | 2000226636 | A | 8/2000 |
| JP | 2000345296 | A | 12/2000 |
| JP | 2003129181 | A | 5/2003 |
| JP | 2004043864 | A | 2/2004 |
| JP | 2005171327 | A | 6/2005 |
| JP | 2009263753 | A | 11/2009 |
| WO | 2014157252 | A1 | 10/2014 |
| WO | 2015182759 | A1 | 12/2015 |

OTHER PUBLICATIONS

Mar. 6, 2023, the Extended European Search Report issued by the European Patent Office in the corresponding European Patent Application No. 20826602.3.

Oct. 19, 2021, Notification of Reasons for Refusal issued by the Japan Patent Office in the corresponding Japanese Patent Application No. 2020-554326 with English language Concise Statement of Relevance.

Sep. 15, 2020, International Search Report issued in the International Patent Application No. PCT/JP2020/022743.

* cited by examiner

RAIL AND MANUFACTURING METHOD THEREFOR

TECHNICAL FIELD

The present disclosure relates to a rail and a manufacturing method therefor.

BACKGROUND

Freight cars used in freight transportation and mining railways have heavier loading weights than passenger cars. This results in heavy loads acting on the axles of the freight cars used in freight transportation and mining railways, and a severe contact environment between the freight car wheels and rails. Rails used under these conditions are expected to exhibit wear resistance, and are made from steel having pearlite and/or bainite as main phase.

As such rails, for example, JP 2000-345296 A (PTL 1) discloses "a pearlitic rail having excellent wear resistance and internal rolling contact fatigue resistance, containing, in mass %, C: more than 0.85% and 1.20% or less, Si: 0.10% to 1.00%, Mn: 0.10% to 1.50%, and V: 0.01% to 0.20%, with the balance consisting of Fe and inevitable impurities".

JP 2009-263753 A (PTL 2) discloses "a high internal hardness rail made of steel that contains, in mass %, C: 0.60% to 0.86%, Si: 0.10% to 1.20%, Mn: 0.40% to 1.50%, and Cr: 0.05% to 2.00% where Ceq defined by the following formula (1) is 1.00 or more and QP defined by the following formula (2) is 7.0 or less, with the balance consisting of Fe and inevitable impurities, wherein a whole surface of a rail head has pearlitic microstructure, hardness from a surface of a top of the rail head to 20 mm inward is HB 370 or more, a hardness difference between the surface of the top of the rail head and a point at least 20 mm inward from the surface is HB 30 or less, and a boundary region between the rail head and a rail column has pearlitic microstructure, $$Ceq=C+Si/10+Mn/4.75+Cr/5.0 \quad \text{formula (1)}$$

$$QP=(0.06+0.4\times C)\times(1+0.64\times Si)\times(1+4.1\times Mn)\times(1+2.33\times Cr) \quad \text{formula (2)},$$

where C, Si, Mn, and Cr denote contents of respective elements in mass %".

WO 2015/182759 A1 (PTL 3) discloses "a rail comprising: a rail head having a head top portion which is a flat region extending on a top of the rail head in an extending direction of the rail, a head side portion which is a flat region extending on a side of the rail head in the extending direction of the rail, and a head corner portion which is a region combining a rounded corner portion extending between the head top portion and the head side portion and an upper half of the head side portion; and a chemical composition containing, in mass %, C: 0.70% to 1.00%, Si: 0.20% to 1.50%, Mn: 0.20% to 1.00%, Cr: 0.40% to 1.20%, P: 0.0250% or less, S: 0.0250% or less, Mo: 0% to 0.50%, Co: 0% to 1.00%, Cu: 0% to 1.00%, Ni: 0% to 1.00%, V: 0% to 0.300%, Nb: 0% to 0.0500%, Mg: 0% to 0.0200%, Ca: 0% to 0.0200%, REM: 0% to 0.0500%, B: 0% to 0.0050%, Zr: 0% to 0.0200%, and N: 0% to 0.0200% with the balance consisting of Fe and impurities, wherein in a region from a head outline surface composed of a surface of the head top portion and a surface of the head corner portion to a depth of 10 mm, a total amount of pearlite microstructure and bainite microstructure is 95 area % or more and an amount of the bainite microstructure is 20 area % or more and less than 50 area %, and an average hardness in the region from the head outline surface to the depth of 10 mm is in a range of Hv 400 to 500".

CITATION LIST

Patent Literature

PTL 1: JP 2000-345296 A
PTL 2: JP 2009-263753 A
PTL 3: WO 2015/182759 A 1

SUMMARY

Technical Problem

For rails used in freight transportation and mining railways, the cumulative wear amount is used as a replacement criterion. For example, a rail is replaced when its cumulative wear amount reaches a replacement reference value (about 15.0 mm to 16.0 mm).

With each of the rails disclosed in PTL 1 to PTL 3, while the wear amount is low initially after the start of the rail service, wear progresses rapidly as the cumulative wear amount approaches the replacement reference value. This causes safety problems because, for example, the cumulative wear amount may exceed the replacement reference value before the rail is replaced.

It could therefore be helpful to provide a rail that is extremely advantageous in terms of not only durability but also safety in the case of being installed in a high axle load environment such as freight transportation and mining railways.

It could also be helpful to provide an advantageous manufacturing method for the rail.

Solution to Problem

We conducted various studies to solve the problem stated above.

First, we repeatedly conducted research and study on the reason why each of the rails disclosed in PTL 1 to PTL 3 wears rapidly as the cumulative wear amount approaches the replacement reference value.

As a result, we discovered the following:

(1) Each of the rails disclosed in PTL 1 to PTL 3 is typically manufactured by heating continuously-cast steel material (bloom) to a temperature range of about 1100° C. to 1250° C., thereafter hot rolling the steel material to obtain a rail, and thereafter spraying a coolant such as air, water, or mist onto the rail to cool the rail.

(2) However, since the cooling by spraying the coolant draws heat from the surface of the rail, the cooling rate inside the rail is lower than the cooling rate at the surface. Consequently, the hardness gradually decreases inward from the rail head surface.

(3) In detail, the hardness of pearlite is significantly influenced by the temperature during pearlite transformation. In particular, the hardness of pearlite is higher when the temperature from the start to end of pearlite transformation is lower as a whole.

However, since the cooling by spraying the coolant draws heat from the surface of the rail, the cooling rate inside the rail is lower than the cooling rate at the surface, as mentioned above (see FIG. 4).

Moreover, the pearlite transformation start temperature and the pearlite transformation end temperature change depending on the time from the heating of the steel even though the chemical composition is the same, as illustrated in a TTT diagram in FIG. 1.

Accordingly, if the cooling by spraying the coolant is simply performed after the hot rolling, pearlite transformation occurs at relatively low temperature near the rail head surface, but the temperature during pearlite transformation increases inside the rail, in particular, the temperature during pearlite transformation increases with an increase in the depth from the rail head surface.

As a result, the hardness gradually decreases inward from the rail head surface, and wear progresses rapidly as the cumulative wear amount approaches the replacement reference value.

We further conducted study based on these discoveries, and came to an idea that the problem stated above can be advantageously solved by:

(4) ensuring the hardness of the rail head surface and the hardness from the rail head surface to a depth position (hereafter also referred to as "the replacement reference position of the rail") corresponding to the replacement reference value of the rail, and adjusting the hardness distribution in the region from the rail head surface to the replacement reference position of the rail, specifically, causing the hardness in a rail head surface-side region (hereafter also referred to as "second internal region") near the replacement reference position of the rail, in particular, a region from 10.0 mm to 16.0 mm in depth from the rail head surface, to be higher than the hardness in a region from 4.0 mm to 8.0 mm in depth (hereafter also referred to as "first internal region") which is closer to the rail head surface than the second internal region is.

We conducted intensive study based on this idea, and consequently discovered the following:

(5) An effective way of causing the hardness in the second internal region to be higher than the hardness in the first internal region is to control, when cooling the rail after the hot rolling, the temperature of the rail head surface as illustrated in FIG. 2. In detail, in the cooling after the hot rolling, the temperature of the rail head surface is rapidly decreased to the vicinity of the lower limit of the pearlite transformation start temperature, specifically, around the temperature at the intersection point between the pearlite transformation start curve and the bainite transformation start curve in the TTT diagram in FIG. 1. After this, the cooling is temporarily stopped or weakened, and the temperature of the rail head surface is increased by heat recuperation and transformation heat generation. Subsequently, the rail is cooled again (or the cooling is strengthened).

(6) This makes it possible to adjust the temperature during pearlite transformation (in particular, intermediate temperature from transformation start to transformation end) in the second internal region so as to be lower than the temperature during pearlite transformation (in particular, intermediate temperature from transformation start to transformation end) in the first internal region and increase the cooling rate during pearlite transformation inside the rail, in particular, in the second internal region, as illustrated in FIG. 3. Consequently, the hardness in the second internal region, in particular, the region from 10.0 mm to 16.0 mm in depth from the rail head surface, can be made higher than the hardness in the first internal region, while ensuring the hardness of the rail head surface and the hardness from the rail head surface to the replacement reference position of the rail. Thus, rapid progress of wear when the cumulative wear amount approaches the replacement reference value can be prevented.

FIG. 3 is a graph in which calculation results of temperature changes in specific depth positions from the rail head surface at transverse symmetry plane positions when cooling the rail under the same cooling conditions as in FIG. 2 are plotted. Two-dimensional differential heat transfer calculation that takes heat generation by phase transformation into consideration was used in calculating (simulating) temperature changes in each part of the rail. In the drawing, the transformation start temperature of each part of the rail was calculated based on the incubation period (the time from when a predetermined temperature is reached to when transformation starts) of the part. The incubation period was calculated from the transformation start time in the TTT (time-temperature-transformation) diagram according to the Scheil equation. The transformation end temperature of each part of the rail is the temperature when 98% of pearlite transformation ends. The temperature when 98% of pearlite transformation ends was calculated using the transformation rate calculated from the transformation start time and the transformation end time in the TTT diagram according to the Johnson-Mehl-Avrami-Kolmogorov (JMAK) equation. FIG. 4 is a graph in which calculation results (temperature changes) of calculating (simulating) temperature changes in each part of the rail by the foregoing computational flow are plotted, as in FIG. 3.

The present disclosure is based on these discoveries and further studies.

We thus provide:

1. A rail comprising a chemical composition containing (consisting of), in mass %, C: 0.60% to 1.00%, Si: 0.10% to 1.50%, Mn: 0.20% to 1.50%, P: 0.035% or less, S: 0.035% or less, and Cr: 0.20% to 2.00%, with a balance consisting of Fe and inevitable impurities, wherein, in a hardness distribution in a region from a rail head surface to a depth of 16.0 mm: a part having higher hardness than V1 is present in a second internal region located deeper than a first internal region from 4.0 mm to 8.0 mm in depth, where V1 is minimum hardness in the first internal region; and hardness of the rail head surface is HBW 400 to 520, and average hardness in the region from the rail head surface to the depth of 16.0 mm is HBW 350 or more.

2. The rail according to 1., wherein the chemical composition further contains, in mass %, one or more selected from the group consisting of V: 0.30% or less, Cu: 1.0% or less, Ni: 1.0% or less, Nb: 0.050% or less, Mo: 0.5% or less, Al: 0.07% or less, W: 1.0% or less, B: 0.005% or less, Ti: 0.05% or less, and Sb: 0.5% or less.

3. The rail according to 1. or 2., wherein a difference between V2 and V1 is HBW 5 or more, where V2 is average hardness in the second internal region.

4. The rail according to any of 1. to 3., wherein the part having higher hardness than V1 is present throughout the second internal region.

5. The rail according to any of 1. to 4., wherein hardness in the second internal region increases continuously in a depth direction from the rail head surface.

6. A manufacturing method for the rail according to any of 1. to 5., the manufacturing method comprising: subjecting a steel material having the chemical composition according to 1. or 2. to hot rolling to obtain a rail; thereafter cooling the rail from a temperature not less than austenite temperature to a first cooling temperature of A−25° C. to A +25° C., at an average cooling rate of 1° C./s to 20° C./s; thereafter holding the rail until a temperature of the rail reaches an intermediate temperature of A+30° C. to A+200° C.; and thereafter cooling the rail at an average cooling rate of 0.5° C./s to 20° C./s for 10 sec or more, wherein A is a temperature at an intersection point between a pearlite transformation start curve and a bainite transformation start curve in a TTT diagram of steel having the chemical composition, and the temperature of the rail and the average cooling rate are respectively a temperature and an average cooling rate at the rail head surface.

Advantageous Effect

According to the present disclosure, rapid progress of wear when the cumulative wear amount of the rail approaches the replacement reference value can be prevented. Hence, even in the case where the rail is installed in a high axle load environment such as freight transportation and mining railways, the rail allows freight cars to run with high safety while ensuring high durability.

DETAILED DESCRIPTION

Figure 1:
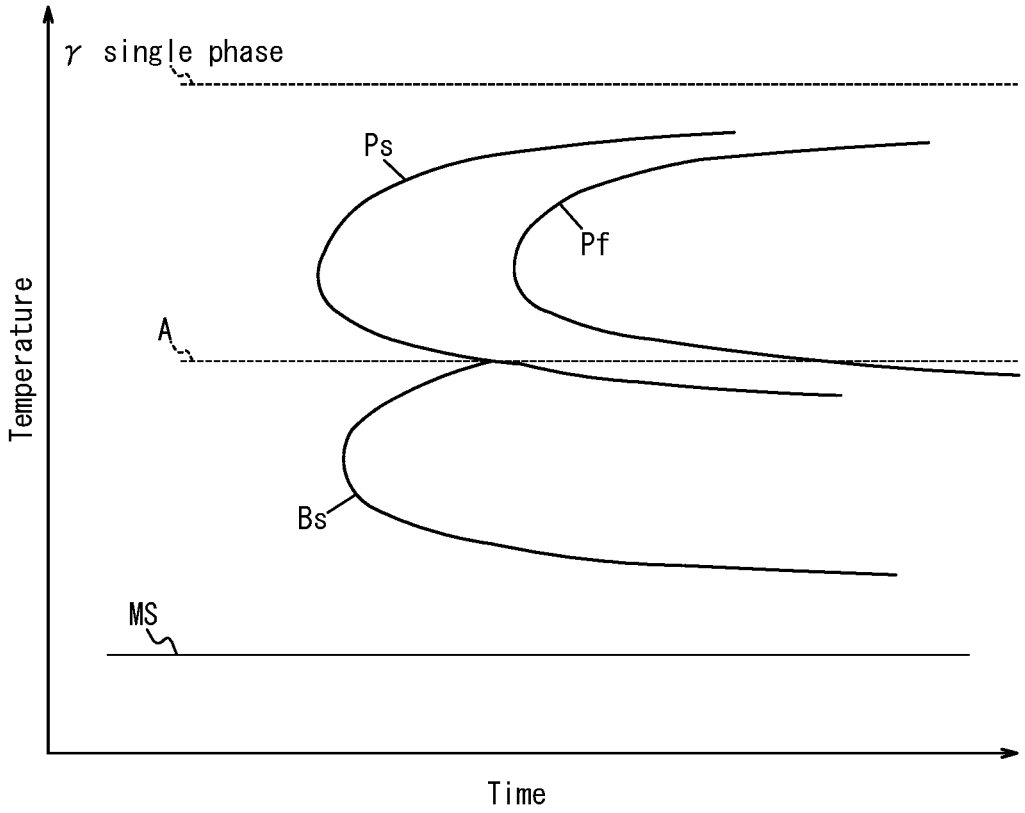
FIG. 1 is a diagram illustrating an example of a TTT diagram.
Figure 2:
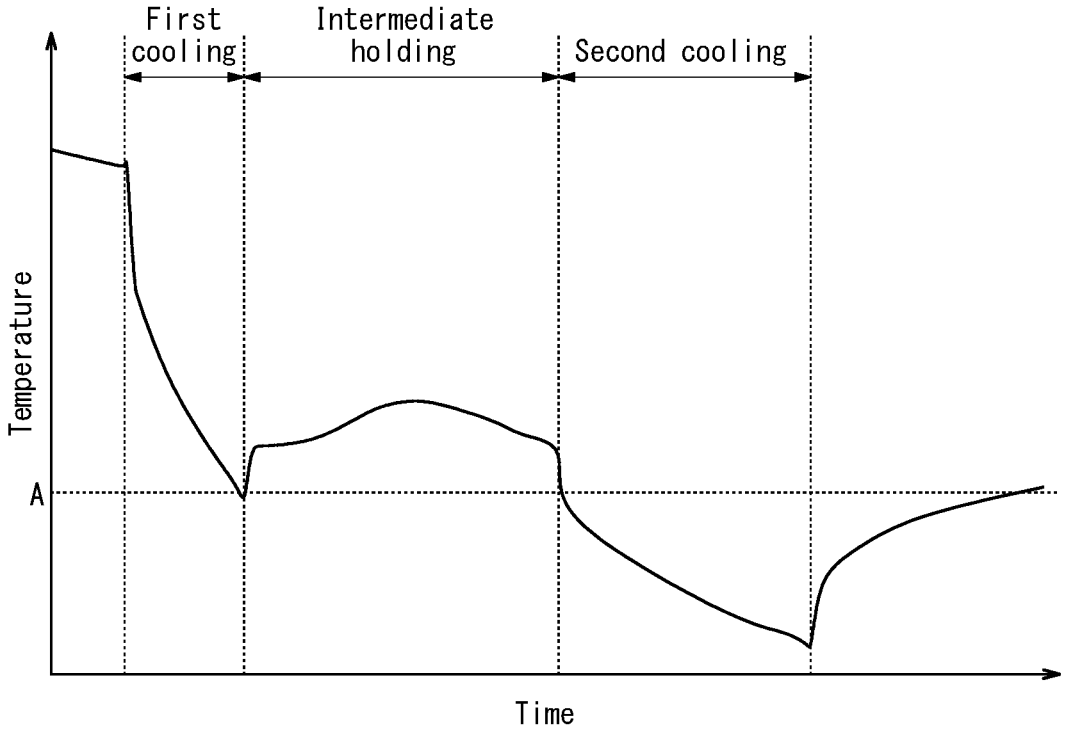
FIG. 2 is a diagram illustrating an example of temperature changes of a rail head surface during cooling after hot rolling according to one of the disclosed embodiments.

One of the disclosed embodiments will be described below. The chemical composition of a rail according to one of the disclosed embodiments will be described first. While the unit in the chemical composition is "mass %", the unit is simply denoted as "%" unless otherwise noted.

C: 0.60% or More and 1.00% or Less

C (carbon) is an important element that forms cementite in a pearlitic rail to enhance the hardness and the strength and improve the wear resistance. To sufficiently achieve this effect, the lower limit of the C content is 0.60%. The C content is preferably 0.70% or more. If the C content is excessively high, the amount of cementite increases. This causes a decrease in ductility, although the hardness and the strength increase. Moreover, an increase of the C content widens the temperature range of the $\gamma+\theta$ region, and promotes softening of a heat-affected zone. The upper limit of the C content is therefore 1.00%. The C content is preferably 0.97% or less.

Si: 0.10% or More and 1.50% or Less

Si (silicon) is added to serve as a deoxidizing material and also strengthen pearlitic microstructure. To sufficiently achieve these effects, the lower limit of the Si content is 0.10%. The Si content is preferably 0.20% or more. If the Si content is excessively high, decarburization is promoted, and rail surface defects form. The upper limit of the Si content is therefore 1.50%. The Si content is preferably 1.30% or less.

Mn: 0.20% or More and 1.50% or Less

Mn (manganese) has the effect of decreasing the pearlite equilibrium transformation temperature (TE) and narrowing the pearlite lamellar spacing. Mn is thus a useful element in obtaining high hardness inside the rail. To sufficiently achieve this effect, the lower limit of the Mn content is 0.20%. The Mn content is preferably 0.40% or more. If the Mn content is more than 1.50%, the pearlite equilibrium transformation temperature (TE) decreases excessively, and martensite transformation tends to occur. The upper limit of the Mn content is therefore 1.50%. The Mn content is preferably 1.30% or less.

P: 0.035% or Less

P (phosphorus) is an element that decreases the toughness and the ductility. The P content is therefore 0.035% or less. The P content is preferably 0.025% or less.

Although it is preferable to reduce the P content as much as possible, if special refining or the like is performed for this purpose, the steelmaking costs increase. The lower limit of the P content is therefore preferably 0.001%.

S: 0.035% or Less

S (sulfur) extends in the rolling direction and forms coarse MnS that decreases the ductility and the toughness. The S content is therefore 0.035% or less. The S content is preferably 0.030% or less, and more preferably 0.015% or less.

Although it is preferable to reduce the S content as much as possible, this requires increases in steelmaking treatment time, solvent, and the like, as a result of which the steelmaking costs increase. The lower limit of the S content is therefore preferably 0.0005%.

Cr: 0.20% or More and 2.00% or Less

Cr (chromium) increases the equilibrium transformation temperature (TE) to contribute to refined pearlite lamellar spacing and increase the hardness and the strength. Moreover, by adding both Cr and the below-described Sb, the formation of a decarburized layer is effectively suppressed. To sufficiently achieve these effects, the lower limit of the Cr content is 0.20%. The Cr content is preferably 0.25% or more, and more preferably 0.30% or more. If the Cr content is more than 2.00%, the possibility of occurrence of weld defects increases. In addition, the quench hardenability increases, and the formation of martensite is promoted. The upper limit of the Cr content is therefore 2.00%. The Cr content is preferably 1.50% or less.

The total content of Si and Cr is preferably 3.00% or less. If the total content of Si and Cr is more than 3.00%, scale adhesion increases excessively, so that descaling is hindered and decarburization is promoted.

While the basic components have been described above, the chemical composition may further contain one or more selected from the group consisting of V: 0.30% or less, Cu: 1.0% or less, Ni: 1.0% or less, Nb: 0.050% or less, Mo: 0.5% or less, Al: 0.07% or less, W: 1.0% or less, B: 0.005% or less, Ti: 0.05% or less, and Sb: 0.5% or less.

V: 0.30% or Less

V (vanadium) is an element that forms VC, VN, or the like and finely precipitates into ferrite, thus contributing to higher strength through strengthening of ferrite by precipitation. V also functions as a hydrogen trapping site and is expected to have the effect of suppressing delayed fractures. To achieve these effects, the V content is preferably 0.001% or more. The V content is more preferably 0.005% or more. If the V content is more than 0.30%, the effects are saturated. Besides, the alloy costs increase excessively. Accordingly, in the case of containing V, the V content is 0.30% or less. The V content is more preferably 0.15% or less, and further preferably 0.12% or less.

Cu: 1.0% or Less

Cu (copper) is an element that contributes to higher hardness by solid solution strengthening. Cu also has the effect of suppressing decarburization. To achieve these effects, the Cu content is preferably 0.01% or more. The Cu content is more preferably 0.05% or more. If the Cu content is more than 1.0%, surface cracks due to embrittlement tend to occur during continuous casting or rolling. Accordingly, in the case of containing Cu, the Cu content is 1.0% or less. The Cu content is more preferably 0.6% or less, and further preferably 0.5% or less.

Ni: 1.0% or Less

Ni (nickel) is an element effective in improving the toughness and the ductility. Ni is also effective in suppressing surface cracks (surface cracks due to embrittlement during continuous casting or rolling) that are likely to occur in the case of containing Cu. Accordingly, in the case of containing Cu, it is preferable to contain Ni, too. To achieve these effects, the Ni content is preferably 0.01% or more. The Ni content is more preferably 0.05% or more. If the Ni content is more than 1.0%, the quench hardenability increases excessively, and the formation of martensite is facilitated. Accordingly, in the case of containing Ni, the Ni content is 1.0% or less. The Ni content is more preferably 0.5% or less, and further preferably 0.3% or less.

Nb: 0.050% or Less

Nb (niobium) is an element effective in improving the ductility and the toughness. In detail, Nb increases the austenite non-recrystallization temperature range to the higher temperature side, and facilitates the introduction of processing strain into austenite microstructure during rolling. Consequently, pearlite colonies and block sizes are refined, and the ductility and the toughness are improved. To achieve this effect, the Nb content is preferably 0.001% or more. The Nb content is more preferably 0.003% or more. If the Nb content is more than 0.050%, Nb carbonitride crystallizes during solidification when casting rail steel material such as bloom, as a result of which the cleanliness decreases. Accordingly, in the case of containing Nb, the Nb content is 0.050% or less. The Nb content is more preferably 0.030% or less, and further preferably 0.025% or less.

Mo: 0.5% or Less

Mo (molybdenum) is an element effective in strengthening. To achieve this effect, the Mo content is preferably 0.001% or more. If the Mo content is more than 0.5%, the quench hardenability increases excessively. As a result, a large amount of martensite forms, and the toughness and the ductility decrease. Accordingly, in the case of containing Mo, the Mo content is 0.5% or less. The Mo content is more preferably 0.3% or less.

Al: 0.07% or Less

Al (aluminum) is an element effective as a deoxidizing material. To achieve this effect, the Al content is preferably 0.01% or more. If the Al content is more than 0.07%, coarse oxide or nitride forms, causing a decrease in rolling contact fatigue resistance. Accordingly, in the case of containing Al, the Al content is 0.07% or less.

W: 1.0% or Less

W (tungsten) forms carbide which finely disperses and precipitates in the steel, contributing to improved wear resistance. W also contributes to improved rolling contact fatigue resistance. To achieve these effects, the W content is preferably 0.01% or more. If the W content is more than 1.0%, the effect of improving the wear resistance and the rolling contact fatigue resistance is saturated. Accordingly, in the case of containing W, the W content is 1.0% or less.

B: 0.005% or Less

B (boron) precipitates as nitride during and/or after rolling, and contributes to improved 0.2% proof stress through strengthening by precipitation. To achieve this effect, the B content is preferably 0.0005% or more. If the B content is more than 0.005%, the quench hardenability increases excessively and martensite forms, as a result of which the rolling contact fatigue resistance decreases. Accordingly, in the case of containing B, the B content is 0.005% or less.

Ti: 0.05% or Less

Ti (titanium) precipitates as carbide, nitride, and/or carbonitride during and/or after rolling, and contributes to improved 0.2% proof stress through strengthening by precipitation. To achieve this effect, the Ti content is preferably 0.005% or more. If the Ti content is more than 0.05%, the precipitated carbide, nitride, and/or carbonitride coarsens, as a result of which the rolling contact fatigue resistance decreases. Accordingly, in the case of containing Ti, the Ti content is 0.05% or less.

Sb: 0.5% or Less

Sb (antimony) has the effect of preventing, when heating rail steel material in a heating furnace, decarburization during the heating. In particular, by adding Sb together with the foregoing Cr, the formation of a decarburized layer can be effectively suppressed. To achieve this effect, the Sb content is preferably 0.005% or more. The Sb content is more preferably 0.01% or more. If the Sb content is more than 0.5%, the effect is saturated. Accordingly, in the case of containing Sb, the Sb content is 0.5% or less. The Sb content is more preferably 0.3% or less.

The balance other than the foregoing components consists of Fe (iron) and inevitable impurities. Examples of the inevitable impurities include N (nitrogen), O (oxygen), and H (hydrogen). The allowable N content is 0.015% or less, the allowable O content is 0.004% or less, and the allowable H content is 0.0003% or less.

The chemical composition of the rail according to one of the disclosed embodiments has been described above. It is very important to, in the rail according to one of the disclosed embodiments, appropriately adjust the hardness distribution in a region from the rail head surface to the vicinity of the replacement reference position of the rail.

Part having higher hardness than V1 being present in second internal region deeper than first internal region, where V1 is minimum hardness in first internal region As mentioned above, if the hardness gradually decreases inward from the rail head surface, wear progresses rapidly as the cumulative wear amount of the rail approaches the replacement reference value. This is likely to be problematic in terms of safety. In view of this, by adjusting the hardness distribution in the region from the rail head surface to the vicinity of the replacement reference position of the rail so that a second internal region (in particular, a region from 10.0 mm to 16.0 mm in depth from the rail head surface) which is a rail head surface-side region near (i.e. in the vicinity of) the replacement reference position of the rail will include a part having higher hardness than the minimum value V1 of hardness in a first internal region (a region from 4.0 mm to 8.0 mm in depth from the rail head surface, which is closer to the rail head surface than the second internal region is), rapid progress of wear when the cumulative wear amount of the rail approaches the replacement reference value can be prevented. Hence, a part having higher hardness than the minimum value V1 of hardness in the first internal region is provided in the second internal region.

The hardness distribution is measured as follows.

In a rail section (a section perpendicular to the longitudinal direction (rolling direction)), the Brinell hardness is measured at 2.0 mm intervals in the depth (height) direction from a position of 2.0 mm in depth from the surface of a rail head top portion (transverse center position) to a position of 16.0 mm in depth, in accordance with JIS Z 2243 (2008). p The diameter of an indenter used is 10 mm, the test force is 29400 N, and the test force holding time is 5 sec.

V1 is the minimum value of hardness measured at positions of 4.0 mm, 6.0 mm, and 8.0 mm in depth from the surface of the rail head top portion.

Difference between V2 (average hardness in second internal region) and V1 : HBW 5 or more The difference (V2--V1) between V2 (average hardness in the second internal region) and V1 is preferably HBW 5 or more, from the viewpoint of preventing rapid progress of wear when the cumulative wear amount of the rail approaches the replacement reference value. The difference between V2 and V1 is more preferably HBW 10 or more, and further preferably HBW 20 or more. The difference between V2 and V1 is preferably HBW 60 or less.

Herein, V2 (average hardness in the second internal region) is the arithmetic mean of hardness at positions of 10.0 mm, 12.0 mm, 14.0 mm, and 16.0 mm in depth from the surface of the rail head top portion.

Part having higher hardness than V1 being present throughout second internal region The part having higher hardness than V1 is preferably present throughout the second internal region, from the viewpoint of preventing rapid progress of wear when the cumulative wear amount of the rail approaches the replacement reference value. Herein, the expression "the part having higher hardness than V1 is present throughout the second internal region" denotes that the hardness at each of the positions of 10.0 mm, 12.0 mm, 14.0 mm, and 16.0 mm in depth from the surface of the rail head top portion is higher than V1.

Hardness in second internal region increasing continuously in depth direction from rail head surface In addition, the hardness in the second internal region preferably increases continuously in the depth direction from the rail head surface, from the viewpoint of preventing rapid progress of wear when the cumulative wear amount of the rail approaches the replacement reference value. Herein, the expression "the hardness in the second internal region increases continuously in the depth direction from the rail head surface" denotes that the respective hardnesses (hereafter also referred to as "hardness at a depth of 10.0 mm", etc.) at positions of 10.0 mm, 12.0 mm, 14.0 mm, and 16.0 mm in depth from the surface of the rail head top portion satisfy

[Hardness at a Depth of 10.0 mm]≤[Hardness at a Depth of 12.0 mm]≤

[hardness at a depth of 14.0 mm]≤[hardness at a depth of 16.0 mm].

Hardness of rail head surface: HBW 400 to 520

If the hardness of the rail head surface is less than HBW 400, it is difficult to ensure sufficient wear resistance in the case where the rail is installed in a high axle load environment such as freight transportation and mining railways. If the hardness of the rail head surface is more than HBW 520, the conformability between the rail head surface and wheels decreases, which may cause damage to the rail surface. The hardness of the rail head surface is therefore in a range of HBW 400 to 520.

The hardness of the rail head surface is measured by measuring the Brinell hardness in the rail head top portion (transverse center position) of the rail head surface in accordance with JIS Z 2243 (2008).

The diameter of an indenter used is 10 mm, the test force is 29400 N, and the test force holding time is 15 sec.

Average value of hardness in region from rail head surface to depth of 16.0 mm (hereafter also referred to as "average internal hardness 1"): HBW 350 or more If the average internal hardness 1 is less than HBW 350, it is difficult to ensure sufficient wear resistance in the case where the rail is installed in a high axle load environment such as freight transportation and mining railways. The average internal hardness 1 is therefore HBW 350 or more.

Herein, the average internal hardness 1 is the arithmetic mean of hardness obtained by measuring the Brinell hardness at 2.0 mm intervals in the depth (height) direction from a position of 2.0 mm in depth from the surface of the rail head top portion (transverse center position) to a position of 16.0 mm in depth.

Given that the rail may be used up to about 25.0 mm in cumulative wear amount, enhancing the hardness in the region from the rail head surface to a depth of 24.0 mm (hereafter also referred to as "average internal hardness 2") is more advantageous in terms of safety. It is therefore more preferable to limit the average internal hardness 2 to HBW 350 or more.

Herein, the average internal hardness 2 is the arithmetic mean of hardness obtained by measuring the Brinell hardness at 2.0 mm intervals in the depth (height) direction from a position of 2.0 mm in depth from the surface of the rail head top portion (transverse center position) to a position of 24.0 mm in depth. The hardness at each position can be measured in the same way as the measurement of the hardness distribution described above.

Rails used in natural resource mines of coal, iron ore, and the like are required to have high wear resistance and high toughness. Particularly on curves, trains are subjected to centrifugal forces, so that large forces are exerted on rails and the rails tend to wear.

In view of this, the steel microstructure of the rail according to one of the disclosed embodiments preferably contains pearlite at an area ratio of 98% or more in the region from the rail head surface to a depth of 24.0 mm, from the viewpoint of obtaining high wear resistance and high toughness. Examples of residual microstructures other than pearlite include martensite and bainite. The area ratio of such residual microstructures is preferably 2% or less. The area ratio of pearlite is more preferably 100%.

The area ratio of pearlite in the region from the rail head surface to a depth of 24.0 mm is measured as follows.

Test pieces for steel microstructure observation are collected from the rail. Test pieces are collected from six locations per one rail so that positions of 0.5 mm, 5.0 mm, 10.0 mm, 15.0 mm, 20.0 mm, and 24.0 mm in depth from the rail head surface will be observation positions. The surface of each collected test piece is then polished, and etched with nital. Following this, each test piece is observed using an optical microscope for one observation field at 200 magnification, the type of microstructure is identified, and the area ratio of pearlite is calculated by image analysis. The arithmetic mean of the area ratios of pearlite at the respective depths is taken to be the area ratio of pearlite in the region from the rail head surface to a depth of 24.0 mm.

The area ratio of the residual microstructures is calculated by subtracting the calculated area ratio of pearlite from 100%.

A manufacturing method for the rail according to one of the disclosed embodiments will be described below.

Steel material used is preferably cast steel, for example, cast steel (bloom) obtained by continuously casting molten steel adjusted to the foregoing chemical composition in a steelmaking process such as blast furnace, hot metal pretreatment, converter, and RH degassing.

The steel material is then carried into, for example, a reheating furnace, and heated preferably to 1100° C. or more. This is mainly intended to sufficiently decrease the deformation resistance and reduce the rolling load, but also intended to achieve homogenization. To sufficiently achieve these effects, the heating temperature is preferably 1100° C. or more. No upper limit is placed on the heating temperature. However, if the heating temperature is excessively high, the material disadvantages such as scale loss and decarburization and the fuel consumption rate for heating increase. The heating temperature is therefore preferably 1250° C. or less.

The steel material is then subjected to hot rolling to obtain a rail. For example, the steel material is subjected to rolling of 1 pass or more in one or more mills such as a breakdown mill, a rougher, and a finisher, to obtain a rail of a final shape. In the hot rolling, any method of caliber rolling and universal rolling may be used.

The rolling finish temperature in the hot rolling is not limited, but is preferably 800° C. or more in the temperature of the rail head surface. This is because, when the rail temperature is higher, the deformation resistance decreases and the rolling load is reduced.

The length of the rail (in the longitudinal direction) after the hot rolling is typically about 50 m to 200 m. The rail may be optionally subjected to hot sawing to, for example, a length of about 25 m.

The rail after the hot rolling or the hot sawing is then conveyed to a heat treatment device through a carry-in table, and cooled by the heat treatment device. It is very important to appropriately control the cooling conditions in the cooling.

Hereafter, the temperature and the average cooling rate of the rail in each of the below-described first cooling, intermediate holding, and second cooling are the temperature and the average cooling rate at the rail head surface.

Cooling from temperature not less than austenite temperature to first cooling temperature of A−25° C. to A+25° C. at average cooling rate of 1° C./s to 20° C./s (hereafter also referred to as "first cooling")

Cooling Start Temperature in First Cooling: Not Less Than Austenite Temperature

The cooling start temperature in the first cooling is not less than the austenite temperature in the temperature of the rail head surface. Accelerated cooling needs to be performed in order to obtain microstructure (hereafter also referred to as "high-hardness pearlitic microstructure") mainly containing pearlite of high hardness with fine lamellar spacing. If the temperature of the rail head surface decreases due to natural cooling before performing accelerated cooling, however, pearlite of high hardness cannot be obtained. Accordingly, the cooling start temperature in the first cooling is not less than the austenite temperature in the temperature of the rail head surface.

The austenite temperature is calculated as follows:

$$[\text{austenite temperature}]=750.8-26.6C+17.6Si-11.6Mn-22.9Cu-23Ni+24.1Cr+22.5Mo-39.7V-5.7Ti+232.4Nb-169.4Al-894.7B,$$

where each element symbol denotes the content (mass %) of the element in the chemical composition of the rail. The content of any element not contained in the chemical composition of the rail is "0".

In the case where the temperature of the rail decreases when conveying to the heat treatment device, the rail may be reheated.

Average Cooling Rate in First Cooling: 1° C./s to 20° C./s

To obtain the desired hardness at the rail head surface, the microstructure around the rail head surface needs to be high-hardness pearlitic microstructure. The average cooling rate in the first cooling is therefore 1° C./s or more. The average cooling rate in the first cooling is preferably 5° C./s or more. If the average cooling rate in the first cooling is more than 20° C./s, a large amount of bainite or martensite forms around the rail head surface, and the wear resistance and the rolling contact fatigue resistance decrease. The average cooling rate in the first cooling is therefore 20° C./s or less. The average cooling rate in the first cooling is preferably 15° C./s or less.

First Cooling Temperature: A−25° C. to A+25° C.

The first cooling temperature (the end-point temperature in the first cooling) is A−25° C. to A+25° C.

Figure 3:
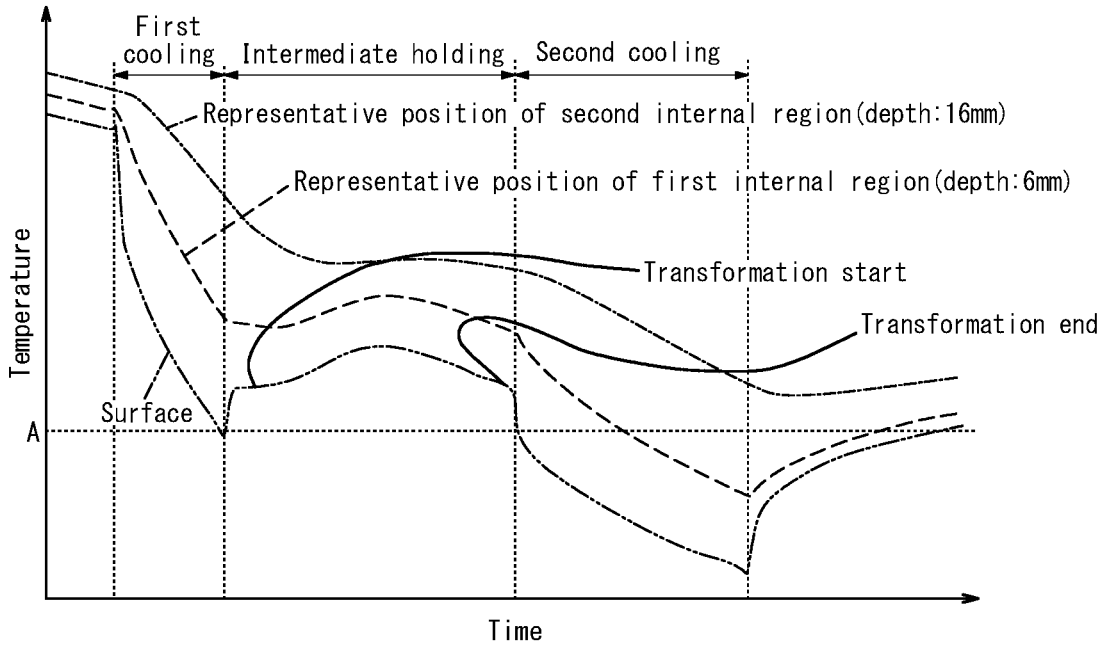
FIG. 3 is a diagram illustrating an example of temperature changes of each of a rail surface, a representative position of a first internal region, and a representative position of a second internal region during cooling after hot rolling according to one of the disclosed embodiments.
Figure 4:
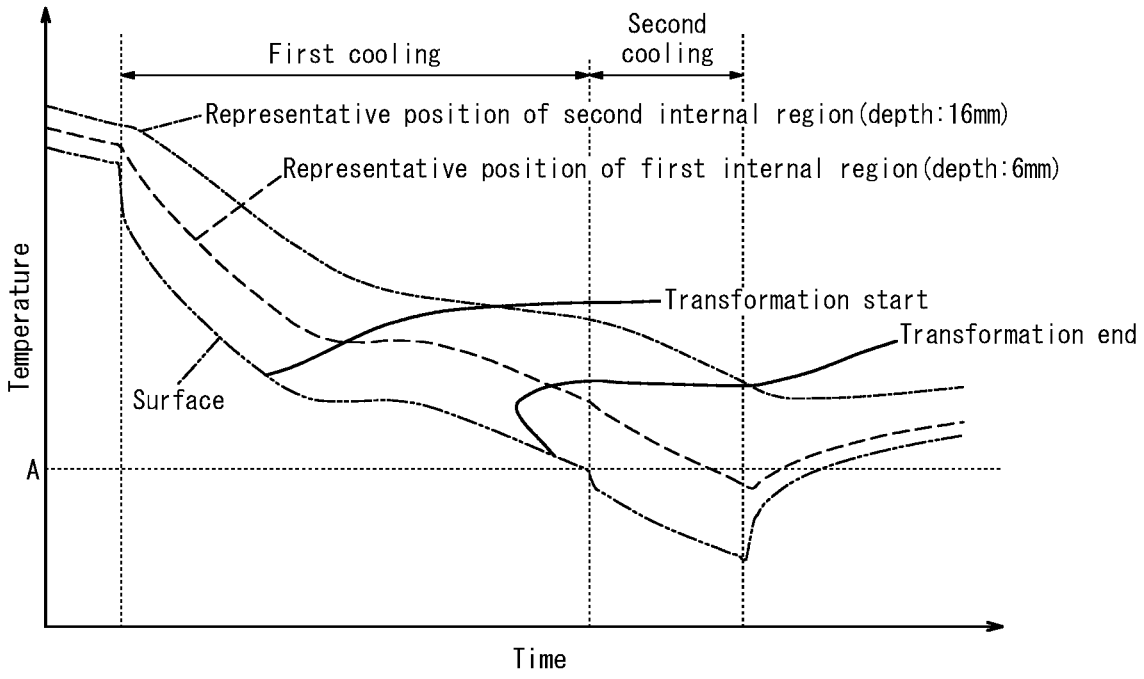
FIG. 4 is a diagram illustrating an example of temperature changes of each of a rail surface, a representative position of a first internal region, and a representative position of a second internal region during conventional cooling after hot rolling.

To obtain the desired hardness distribution in the region from the rail head surface to the vicinity of the replacement reference position of the rail, it is important to perform rapid cooling to around the temperature A at the intersection point between the pearlite transformation start curve and the bainite transformation start curve in the TTT diagram in FIG. 1 and thereafter stop or weaken the cooling to increase the temperature of the rail head surface by heat recuperation and transformation heat generation, as mentioned above. This makes it possible to adjust the temperature during pearlite transformation (intermediate temperature from transformation start to transformation end) in the second internal region to be lower than the temperature during pearlite transformation (intermediate temperature from transformation start to transformation end) in the first internal region and increase the cooling rate during pearlite transformation in the second internal region (specifically, increase the cooling rate to be higher than the cooling rate in the temperature range corresponding to the second cooling in the second internal region in the case of performing typical cooling (conventional cooling after hot rolling as illustrated in FIG. 4)), as illustrated in FIG. 3. Consequently, the hardness in the second internal region can be made higher than the hardness in the first internal region. Moreover, pearlite transformation in the vicinity of the rail head surface (specifically, from the surface to a depth of about 5 mm) ends early, so that transformation heat generation in this part will not occur in the below-described second cooling. Thus, a sufficient cooling rate is achieved inside the rail, in particular, in the part corresponding to the second internal region, and high-hardness pearlitic microstructure is obtained.

If the first cooling temperature is less than A−25° C., the foregoing control is impossible, and the hardness in the second internal region cannot be made higher than the hardness in the first internal region. If the first cooling temperature is more than A+25° C., too, the foregoing control is impossible, and the hardness in the second internal region cannot be made higher than the hardness in the first internal region.

The first cooling temperature is therefore in a range of A−25° C. to A+25° C. The first cooling temperature is preferably in a range of A−15° C. to A+15° C.

Herein, A is the temperature at the intersection point between the pearlite transformation start curve and the bainite transformation start curve in the TTT diagram.

The TTT diagram can be generated as follows: A certain test piece is heated to not less than the austenite temperature, thereafter compressed to simulate rolling, thereafter rapidly cooled to each of various test temperatures, and thereafter held at the test temperature. The expansion and contraction (displacement) of the test piece when held at the test temperature are measured to generate the TTT diagram.

For example, a cylindrical test piece of ϕ8 mm×12 mm in length is collected from a predetermined position (position corresponding to the rail head after hot rolling) of the steel material after casting and before hot rolling. In a heat treatment furnace of a nitrogen atmosphere, the collected test piece is heated to the foregoing heating temperature of the steel material at a heating rate of 10° C./sec, and held for 5 min. The test piece is then cooled at a cooling rate of 1° C./sec, to reduce the test piece from 12 mm to 10 mm in length when the temperature of the test piece is 1100° C., 10 mm to 8 mm in length when the temperature of the test piece is 1000° C., and 8 mm to 6 mm in length when the temperature of the test piece is 900° C. The test piece is then cooled from 900° C. to each test temperature at 30° C./sec, and held at the test temperature for 3600 sec. The test then ends. During the test, the displacement in the longitudinal direction of the test piece is continuously measured.

Following this, a change curve in the longitudinal direction of the test piece, called DILAT, is formed, where the horizontal axis represents the time t (sec) from when the test temperature is reached and the vertical axis represents the length (mm) of the test piece. The DILAT is then approximated by the following formula:

$$f = \frac{X_1 - X_2}{\exp(-a(t-b)) + 1} + X_2$$

where X1 is the length of the test piece before the transformation start and X2 is the length of the test piece after the transformation end.

Since the length of the test piece is unchanged before the transformation start and unchanged after the transformation end, X1 and X2 can be identified by continuously measuring the displacement in the longitudinal direction of the test piece during the test. The least-square method is used in the approximation, and the coefficients a and b are determined.

According to the formula, the value of f (transformation ratio f) at time t is derived. The point at which the transformation ratio f is 0.02 is defined as a transformation start point, and the point at which the transformation ratio f is 0.98 is defined as a transformation end point. For each test temperature, the time (time from when the test temperature is reached on the horizontal axis) at the transformation start point and the time (time from when the test temperature is reached on the horizontal axis) at the transformation end point are specified. After the test, each test piece is etched with nital or the like, and its microstructure is photographed using an optical microscope to determine the type of transformation (pearlite transformation, bainite transformation, or martensite transformation).

After this, the pearlite transformation start curve (Ps) and the bainite transformation start curve (Bs) (optionally, the pearlite transformation end curve (Pf)) as illustrated in FIG. 1 are formed by plotting the time at the transformation start point and the time at the transformation end point obtained for each test temperature, where the horizontal axis represents the time t (sec) from when the test temperature is reached and the vertical axis represents the temperature (° C.). The temperature at the intersection point between the pearlite transformation start curve (Ps) and the bainite transformation start curve (Bs) is then taken to be A.

The cooling time in the first cooling is typically about 10 sec to 60 sec.

Holding until temperature of rail reaches intermediate temperature of A+30° C. to A+200° C. after first cooling (hereafter also referred to as "intermediate holding")

Intermediate Temperature: A+30° C. to A+200° C.

To obtain the desired hardness distribution in the region from the rail head surface to the vicinity of the replacement reference position of the rail, it is important to, after the rapid cooling to around the temperature A in the first cooling, stop or weaken the cooling to increase the temperature of the rail head surface by heat recuperation and transformation heat generation, as mentioned above.

In particular, if the intermediate temperature is less than A+30° C., pearlite transformation in the vicinity of the rail head surface cannot end early. Consequently, the sufficient cooling rate cannot be obtained in the part corresponding to the second internal region in the below-described second cooling due to transformation heat generation, causing the hardness in the second internal region to be not higher than the hardness in the first internal region. If the intermediate temperature is more than A+200° C., pearlite transformation progresses excessively even in the part corresponding to the second internal region in the intermediate holding, causing the hardness in the second internal region to be not higher than the hardness in the first internal region.

The intermediate holding temperature is therefore in a range of A+30° C. to A+200° C. The intermediate holding temperature is preferably in a range of A+40° C. to A+100° C.

The holding time in the intermediate holding (the time to reach the intermediate holding temperature from the first cooling temperature) is typically about 10 sec to 150 sec.

Cooling rail at average cooling rate of 0.5° C./s to 20° C./s for 10 sec or more after intermediate holding (hereafter also referred to as "second cooling")

Average Cooling Rate in Second Cooling: 0.5° C./s to 20° C./s

To make the hardness in the second internal region higher than the hardness in the first internal region, it is important to perform, after the intermediate holding, rapid cooling to form high-hardness pearlitic microstructure in the second internal region. The average cooling rate in the second cooling is therefore 0.5° C./s or more. The average cooling rate in the second cooling is preferably 1.0° C./s or more. If the average cooling rate in the second cooling is more than 20° C./s, a large amount of bainite or martensite forms in the first internal region or the second internal region, and the wear resistance and the rolling contact fatigue resistance decrease. The average cooling rate in the second cooling is therefore 20° C./s or less. The average cooling rate in the second cooling is preferably 5° C./s or less.

Cooling Time in Second Cooling: 10 sec or More

The cooling time in the second cooling is 10 sec or more, from the viewpoint of forming a sufficient amount of high-hardness pearlitic microstructure in the second internal region. The cooling time in the second cooling is preferably 150 sec or more. No upper limit is placed on the cooling time in the second cooling, but the upper limit is preferably 300 sec.

The cooling stop temperature in the second cooling (hereafter also referred to as "second cooling stop temperature") is preferably 650° C. or less in the temperature of the rail head surface, from the viewpoint of avoiding a decrease in hardness due to spheroidizing of cementite in pearlite. The second cooling stop temperature is more preferably 500° C. or less. In particular, a temperature difference of about 50° C. at a maximum occurs between the rail inside and the rail head surface during cooling (although this depends on the rail size). Given such temperature difference, the second cooling stop temperature is further preferably less than 450° C. in the temperature of the rail head surface.

No lower limit is placed on the second cooling stop temperature. However, even when cooling is performed to 300° C. or less, this has substantially no influence on the hardness because the part of 25 mm in depth has already transformed. Accordingly, the lower limit of the second cooling stop temperature is preferably about 300° C., given the lead time, the coolant spray costs, and the like.

After the second cooling, the rail is conveyed from the heat treatment device to a cooling bed through a carry-out table, and cooled to room temperature to about 200° C. The rail is then subjected to predetermined inspection (for example, Brinell hardness test or Vickers hardness test) and then shipped.

EXAMPLES

Steels having the chemical compositions (with the balance consisting of Fe and inevitable impurities) in Table 1 were each continuously cast to obtain steel material (bloom).

The cast steel material was reheated in a heating furnace to a temperature of 1100° C. or more. The steel material was then taken out of the heating furnace, and hot rolled using a breakdown mill, a rougher, and a finisher so that its section shape would be a final rail shape (141-pound rail in the AREMA standards), to obtain a rail.

The obtained rail was then conveyed to a heat treatment device, and cooled under the conditions shown in Table 2. For each steel sample ID in Table 1, a TTT diagram was formed to determine A (° C.) beforehand. A for each steel sample ID is shown in Table 2. When forming the TTT diagram, the isothermal holding temperature was changed in increments of 10° C.

After this, the rail was taken from the heat treatment device to a carry-out table and conveyed to a cooling bed, and cooled to 50° C. by the cooling bed. The rail was then adjusted using a roller.

From each rail manufactured in this way, the hardness of the rail head surface and the hardness at each position of 2.0 mm to 24.0 mm in depth from the rail head (rail head top) surface were measured with 2.0 mm pitches, by the foregoing method. The measurement results are shown in Table 3.

In addition, a predetermined test piece was collected from each manufactured rail and the steel microstructure was observed by the foregoing method. All Examples had microstructure containing pearlite at an area ratio of 98% or more in the region from the rail head surface to a depth of 24.0 mm.

TABLE 1

| Steel sample | Chemical composition (mass %) | | | | | | | | | | | | | | | | Austenite temperature | |
|---|---|---|---|---|---|---|---|---|---|---|---|---|---|---|---|---|---|---|
| ID | C | Si | Mn | P | S | Cr | V | Cu | Ni | Nb | Mo | Al | W | B | Ti | Sb | (° C.) | Remarks |
| A | 0.86 | 1.13 | 1.41 | 0.011 | 0.0130 | 0.25 | — | — | — | — | — | — | — | — | — | — | 738 | Conforming steel |
| B | 0.69 | 1.14 | 1.36 | 0.013 | 0.0037 | 0.88 | — | — | — | — | — | — | — | — | — | — | 758 | Conforming steel |
| C | 0.97 | 0.54 | 0.89 | 0.019 | 0.0346 | 0.51 | — | — | — | — | — | — | — | — | — | — | 736 | Conforming steel |
| D | 0.75 | 0.65 | 0.25 | 0.007 | 0.0118 | 0.75 | — | — | — | — | — | — | — | — | — | — | 757 | Conforming steel |
| E | 0.72 | 1.04 | 1.50 | 0.023 | 0.0092 | 0.81 | — | — | — | — | — | — | — | — | — | — | 752 | Conforming steel |
| F | 0.89 | 0.47 | 0.98 | 0.007 | 0.0103 | 0.66 | — | — | — | — | — | — | 0.050 | — | — | — | 740 | Conforming steel |
| G | 0.61 | 1.31 | 1.48 | 0.009 | 0.0047 | 1.91 | — | — | — | — | — | — | — | — | — | — | 762 | Conforming steel |
| H | 0.84 | 0.21 | 1.12 | 0.007 | 0.0050 | 0.52 | — | — | — | — | — | 0.029 | — | — | — | — | 727 | Conforming steel |
| I | 0.80 | 1.48 | 0.49 | 0.009 | 0.0017 | 0.77 | — | 0.45 | 0.21 | — | — | — | — | — | — | — | 753 | Conforming steel |
| J | 0.85 | 0.35 | 1.15 | 0.007 | 0.0080 | 0.49 | — | — | — | — | 0.22 | — | — | — | — | — | 738 | Conforming steel |
| K | 0.75 | 0.99 | 1.12 | 0.008 | 0.0061 | 0.96 | 0.042 | — | — | — | — | — | — | — | — | — | 751 | Conforming steel |
| L | 0.80 | 1.07 | 0.73 | 0.028 | 0.0024 | 0.75 | — | — | — | 0.014 | — | — | — | — | — | — | 761 | Conforming steel |

TABLE 1-continued

| Steel sample | Chemical composition (mass %) | | | | | | | | | | | | | | | | Austenite temperature | |
|---|---|---|---|---|---|---|---|---|---|---|---|---|---|---|---|---|---|---|
| ID | C | Si | Mn | P | S | Cr | V | Cu | Ni | Nb | Mo | Al | W | B | Ti | Sb | (° C.) | Remarks |
| M | 0.70 | 0.63 | 1.00 | 0.031 | 0.0049 | 0.61 | — | — | — | — | — | — | — | 0.0013 | 0.03 | — | 745 | Conforming steel |
| N | 0.74 | 0.52 | 0.95 | 0.011 | 0.0078 | 0.77 | — | — | — | — | — | — | — | — | — | 0.014 | 748 | Conforming steel |
| ***O*** | ***0.58*** | 0.80 | 0.79 | 0.006 | 0.0004 | 0.72 | — | — | — | — | — | — | — | — | — | — | 758 | Comparative steel |
| ***P*** | ***1.02*** | 0.78 | 0.60 | 0.010 | 0.0013 | 0.55 | — | — | — | — | — | — | — | — | — | — | 744 | Comparative steel |
| ***Q*** | 0.64 | ***0.08*** | 1.00 | 0.008 | 0.0055 | 0.21 | — | — | — | — | — | — | — | — | — | — | 729 | Comparative steel |
| ***R*** | 0.93 | ***1.52*** | 0.39 | 0.009 | 0.0033 | 0.63 | — | — | — | — | — | — | — | — | — | — | 763 | Comparative steel |
| ***S*** | 0.65 | 1.03 | ***0.18*** | 0.010 | 0.0085 | 0.23 | — | — | — | — | — | — | — | — | — | — | 755 | Comparative steel |
| ***T*** | 0.83 | 1.19 | ***1.52*** | 0.012 | 0.0099 | 0.39 | — | — | — | — | — | — | — | — | — | — | 741 | Comparative steel |
| ***U*** | 0.99 | 1.24 | 1.04 | 0.015 | 0.0014 | ***0.18*** | — | — | — | — | — | — | — | — | — | — | 739 | Comparative steel |
| ***V*** | 0.85 | 0.92 | 1.38 | 0.004 | 0.0016 | ***2.03*** | — | — | — | — | — | — | — | — | — | — | 753 | Comparative steel |

TABLE 2

| | | | Manufacturing conditions | | | | | | | | | |
|---|---|---|---|---|---|---|---|---|---|---|---|---|
| | | | First cooling | | | | Intermediate holding | | Second cooling | | | |
| No. | Steel sample ID | A (° C.) | Cooling start temperature (° C.) | Average cooling rate (° C./sec) | Cooling time (sec) | First cooling temperature (° C.) | Intermediate temperature (° C.) | Holding time (sec) | Average cooling rate (° C./sec) | Cooling time (sec) | Second cooling stop temperature (° C.) | Remarks |
| 1 | A | 480 | 750 | 8.1 | 34 | 474 | 628 | 84 | 1.7 | 160 | 350 | Example |
| 2 | A | 480 | 750 | 5.5 | 47 | 490 | — | — | 0.6 | 231 | 350 | Comparative Example |
| 3 | B | 530 | 790 | 8.7 | 30 | 530 | 606 | 60 | 1.3 | 192 | 350 | Example |
| 4 | B | 530 | 790 | 6.8 | 36 | 548 | — | — | 0.8 | 246 | 350 | Comparative Example |
| 5 | C | 490 | 770 | 8.3 | 34 | 488 | 615 | 52 | 1.4 | 196 | 350 | Example |
| 6 | C | 490 | 770 | 5.8 | 46 | 504 | — | — | 0.7 | 236 | 350 | Comparative Example |
| 7 | D | 540 | 780 | 9.0 | 26 | 546 | 596 | 70 | 2.6 | 56 | 450 | Example |
| 8 | D | 540 | 780 | 6.8 | 32 | 562 | — | — | 0.9 | 120 | 450 | Comparative Example |
| 9 | E | 510 | 790 | 7.3 | 38 | 511 | 584 | 96 | 1.4 | 168 | 350 | Example |
| 10 | E | 510 | 790 | 5.6 | 46 | 530 | — | — | 0.7 | 256 | 350 | Comparative Example |
| 11 | F | 510 | 780 | 6.8 | 40 | 510 | 613 | 50 | 1.4 | 190 | 350 | Example |
| 12 | F | 510 | 780 | 4.9 | 52 | ***527*** | — | — | 0.8 | 228 | 350 | Comparative Example |
| 13 | G | 540 | 780 | 9.0 | 26 | 546 | 580 | 42 | 1.2 | 198 | 350 | Example |
| 14 | G | 540 | 780 | 6.6 | 33 | 563 | — | — | 0.9 | 233 | 350 | Comparative Example |
| 15 | H | 500 | 760 | 6.1 | 42 | 503 | 589 | 92 | 1.4 | 168 | 350 | Example |
| 16 | H | 500 | 760 | 5.0 | 47 | 523 | — | — | 0.7 | 255 | 350 | Comparative Example |

TABLE 2-continued

| | | | Manufacturing conditions | | | | | | | | | |
|---|---|---|---|---|---|---|---|---|---|---|---|---|
| | | | First cooling | | | | Intermediate holding | | Second cooling | | | |
| No. | Steel sample ID | A (° C.) | Cooling start temperature (° C.) | Average cooling rate (° C./sec) | Cooling time (sec) | First cooling temperature (° C.) | Intermediate temperature (° C.) | Holding time (sec) | Average cooling rate (° C./sec) | Cooling time (sec) | Second cooling stop temperature (° C.) | Remarks |
| 17 | I | 540 | 790 | 10.6 | 24 | 535 | 621 | 44 | 1.3 | 208 | 350 | Example |
| 18 | I | 540 | 790 | 8.2 | 29 | 550 | — | — | 0.8 | 247 | 350 | Comparative Example |
| 19 | J | 500 | 770 | 6.4 | 42 | 503 | 598 | 80 | 1.4 | 174 | 350 | Example |
| 20 | J | 500 | 770 | 4.6 | 55 | 519 | — | — | 0.7 | 241 | 350 | Comparative Example |
| 21 | K | 530 | 790 | 8.7 | 30 | 530 | 580 | 90 | 1.3 | 174 | 350 | Example |
| 22 | K | 530 | 790 | 5.9 | 41 | 547 | — | — | 0.8 | 253 | 350 | Comparative Example |
| 23 | L | 550 | 800 | 10.3 | 24 | 554 | 597 | 68 | 1.3 | 192 | 350 | Example |
| 24 | L | 550 | 800 | 5.9 | 39 | 570 | — | — | 0.9 | 245 | 350 | Comparative Example |
| 25 | M | 550 | 780 | 10.1 | 22 | 558 | 582 | 80 | 1.2 | 186 | 350 | Example |
| 26 | M | 550 | 780 | 7.4 | 28 | 575 | — | — | 0.9 | 260 | 350 | Comparative Example |
| 27 | N | 540 | 780 | 9.2 | 26 | 541 | 596 | 70 | 2.6 | 56 | 450 | Example |
| 28 | N | 540 | 780 | 6.2 | 36 | 557 | — | — | 0.9 | 116 | 450 | Comparative Example |
| 29 | ***O*** | 610 | 790 | 14.8 | 12 | 613 | 646 | 18 | 1.2 | 238 | 350 | Comparative Example |
| 30 | ***P*** | 510 | 780 | 4.5 | 60 | 511 | — | — | 0.8 | 202 | 350 | Comparative Example |
| 31 | ***Q*** | 570 | 760 | 9.4 | 20 | 573 | 638 | 26 | 1.3 | 228 | 350 | Comparative Example |
| 32 | ***R*** | 550 | 800 | 5.7 | 44 | 551 | — | — | 0.9 | 218 | 350 | Comparative Example |
| 33 | ***S*** | 630 | 790 | 6.0 | 26 | 635 | — | — | 1.1 | 250 | 350 | Comparative Example |
| 34 | ***T*** | 470 | 780 | 5.5 | 56 | 473 | 540 | 132 | 1.7 | 114 | 350 | Comparative Example |
| 35 | ***U*** | 470 | 770 | 3.2 | 94 | 471 | — | — | 0.7 | 172 | 350 | Comparative Example |
| 36 | ***V*** | 480 | 790 | 5.5 | 55 | 485 | 555 | 133 | 1.6 | 96 | 400 | Comparative Example |

TABLE 3

| | | Hardness measurement results (HBW) | | | | | | | | |
|---|---|---|---|---|---|---|---|---|---|---|
| | | | | First internal region | | | | Second internal region | | |
| No. | Steel sample ID | Rail head surface | Depth 2.0 mm position | Depth 4.0 mm position | Depth 6.0 mm position | Depth 8.0 mm position | Minimum value V1 | Depth 10.0 mm position | Depth 12.0 mm position | Depth 14.0 mm position |
| 1 | A | 435 | 414 | 400 | 392 | 404 | 392 | 415 | 421 | 424 |
| 2 | A | 436 | 415 | 402 | 394 | 390 | 390 | 387 | 385 | 384 |
| 3 | B | 425 | 406 | 395 | 419 | 431 | 395 | 438 | 441 | 439 |
| 4 | B | 427 | 406 | 398 | 396 | 395 | 395 | 394 | 394 | 394 |
| 5 | C | 432 | 414 | 402 | 415 | 427 | 402 | 431 | 434 | 435 |
| 6 | C | 431 | 415 | 405 | 398 | 395 | 395 | 392 | 391 | 390 |
| 7 | D | 427 | 406 | 396 | 422 | 434 | 396 | 441 | 443 | 441 |
| 8 | D | 428 | 406 | 399 | 397 | 396 | 396 | 396 | 395 | 395 |
| 9 | E | 456 | 429 | 411 | 401 | 396 | 396 | 399 | 420 | 433 |
| 10 | E | 457 | 431 | 414 | 404 | 397 | 397 | 392 | 390 | 388 |
| 11 | F | 429 | 410 | 398 | 398 | 414 | 398 | 423 | 428 | 430 |
| 12 | F | 427 | 412 | 402 | 396 | 392 | 392 | 390 | 389 | 388 |
| 13 | G | 444 | 409 | 393 | 395 | 406 | 393 | 407 | 407 | 404 |
| 14 | G | 444 | 409 | 395 | 389 | 387 | 387 | 386 | 385 | 385 |
| 15 | H | 443 | 420 | 404 | 394 | 390 | 390 | 391 | 408 | 419 |
| 16 | H | 441 | 422 | 406 | 395 | 386 | 386 | 379 | 373 | 369 |
| 17 | I | 409 | 391 | 407 | 419 | 422 | 407 | 422 | 420 | 415 |
| 18 | I | 430 | 410 | 400 | 395 | 393 | 393 | 391 | 391 | 390 |
| 19 | J | 453 | 431 | 416 | 406 | 400 | 400 | 411 | 425 | 434 |
| 20 | J | 455 | 432 | 419 | 412 | 408 | 408 | 406 | 405 | 405 |

TABLE 3-continued

| | | | | | | | | | | |
|---|---|---|---|---|---|---|---|---|---|---|
| 21 | K | 458 | 429 | 414 | 409 | 427 | 409 | 448 | 462 | 469 |
| 22 | K | 457 | 429 | 417 | 412 | 410 | 410 | 409 | 409 | 409 |
| 23 | L | 429 | 408 | 398 | 424 | 435 | 398 | 441 | 441 | 438 |
| 24 | L | 430 | 410 | 402 | 398 | 397 | 397 | 397 | 397 | 396 |
| 25 | M | 425 | 403 | 394 | 419 | 428 | 394 | 433 | 433 | 430 |
| 26 | M | 426 | 403 | 397 | 395 | 394 | 394 | 394 | 394 | 394 |
| 27 | N | 427 | 407 | 395 | 421 | 433 | 395 | 440 | 444 | 445 |
| 28 | N | 426 | 407 | 398 | 394 | 392 | 392 | 391 | 391 | 390 |
| 29 | ***O*** | ***343*** | 358 | 360 | 358 | 353 | 353 | 347 | 341 | 337 |
| 30 | ***P*** | 448 | 417 | 409 | 406 | 401 | 401 | 395 | 387 | 381 |
| 31 | ***Q*** | ***345*** | 362 | 363 | 363 | 359 | 359 | 354 | 349 | 345 |
| 32 | ***R*** | 442 | 405 | 395 | 390 | 385 | 385 | 379 | 369 | 365 |
| 33 | ***S*** | ***306*** | 308 | 306 | 303 | 300 | 300 | 296 | 292 | 288 |
| 34 | ***T*** | 488 | 463 | 436 | 421 | 411 | 411 | 403 | 395 | 388 |
| 35 | ***U*** | 455 | 419 | 405 | 400 | 395 | 395 | 388 | 381 | 376 |
| 36 | ***V*** | 428 | 420 | 418 | 410 | 408 | 408 | 405 | 405 | 403 |

| | Hardness measurement results (HBW) | | | | Part having higher | | |
|---|---|---|---|---|---|---|---|
| | Second internal region | | | | | | |
| No. | Depth 16.0 mm position | Average value V2 | Average internal hardness 1 (to depth of 16.0 mm) | Average internal hardness 2 (to depth of 24.0 mm) | hardness in second internal region than V1 | V2-V1 | Remarks |
| 1 | 425 | 421 | 412 | ħ | Present | 29 | Example |
| 2 | 383 | 385 | 393 | 386 | ***Not present*** | −5 | Comparative Example |
| 3 | 435 | 438 | 426 | 425 | Present | 43 | Example |
| 4 | 394 | 394 | 396 | 389 | ***Not present*** | 0 | Comparative Example |
| 5 | 434 | 434 | 424 | 425 | Present | 32 | Example |
| 6 | 390 | 391 | 397 | 390 | ***Not present*** | −4 | Comparative Example |
| 7 | 437 | 441 | 428 | 426 | Present | 45 | Example |
| 8 | 395 | 395 | 398 | 391 | ***Not present*** | 0 | Comparative Example |
| 9 | 441 | 423 | 416 | 428 | Present | 27 | Example |
| 10 | 387 | 389 | 400 | 396 | ***Not present*** | −8 | Comparative Example |
| 11 | 431 | 428 | 417 | 420 | Present | 30 | Example |
| 12 | 387 | 388 | 394 | 387 | ***Not present*** | −4 | Comparative Example |
| 13 | 401 | 405 | 403 | 403 | Present | 12 | Example |
| 14 | 385 | 385 | 390 | 386 | ***Not present*** | −1 | Comparative Example |
| 15 | 427 | 411 | 407 | 417 | Present | 21 | Example |
| 16 | 365 | 371 | 387 | 382 | ***Not present*** | −14 | Comparative Example |
| 17 | 410 | 417 | 413 | 409 | Present | 10 | Example |
| 18 | 390 | 391 | 395 | 388 | ***Not present*** | −2 | Comparative Example |
| 19 | 440 | 428 | 420 | 429 | Present | 28 | Example |
| 20 | 404 | 405 | 412 | 405 | ***Not present*** | −3 | Comparative Example |
| 21 | 470 | 462 | 441 | 447 | Present | 53 | Example |
| 22 | 409 | 409 | 413 | 407 | ***Not present*** | −1 | Comparative Example |
| 23 | 433 | 438 | 427 | 425 | Present | 40 | Example |
| 24 | 396 | 397 | 399 | 392 | ***Not present*** | −1 | Comparative Example |
| 25 | 426 | 431 | 421 | 418 | Present | 37 | Example |
| 26 | 394 | 394 | 396 | 389 | ***Not present*** | 0 | Comparative Example |
| 27 | 445 | 444 | 429 | 426 | Present | 49 | Example |
| 28 | 390 | 391 | 394 | 387 | ***Not present*** | −1 | Comparative Example |
| 29 | 334 | 340 | 349 | 342 | ***Not present*** | −13 | Comparative Example |
| 30 | 377 | 385 | 397 | 392 | ***Not present*** | −16 | Comparative Example |
| 31 | 341 | 347 | 355 | 347 | ***Not present*** | −12 | Comparative Example |
| 32 | 362 | 369 | 381 | 380 | ***Not present*** | −16 | Comparative Example |
| 33 | 285 | 290 | ***297*** | 292 | ***Not present*** | −10 | Comparative Example |
| 34 | 385 | 393 | 413 | 412 | ***Not present*** | −18 | Comparative Example |
| 35 | 371 | 379 | 392 | 388 | ***Not present*** | −16 | Comparative Example |
| 36 | 401 | 404 | 409 | 401 | ***Not present*** | −5 | Comparative Example |

As shown in Table 3, in all Examples, sufficient hardness was obtained at the rail head surface and inside the rail, and a part having higher hardness than the minimum hardness in the first internal region was present in the second internal region. Thus, all Examples were extremely advantageous in terms of not only durability but also safety.

In Comparative Examples, sufficient hardness was not obtained at the rail head surface and inside the rail, or the hardness in the second internal region decreased continuously from the first internal region.

The invention claimed is:

1. A rail comprising a chemical composition consisting of, in mass %,

C: 0.60% to 0.84%,

Si: 0.10% to 1.50%,

Mn: 0.20% to 1.50%,

P: 0.035% or less,
S: 0.035% or less,
Cr: 0.49% to 2.00%, and optionally
one or more selected from the group consisting of
V: 0.30% or less,
Cu: 1.0% or less,
Ni: 1.0% or less,
Nb: 0.050% or less,
Mo: 0.5% or less,
Al: 0.07% or less,
W: 1.0% or less,
B: 0.005% or less, and
Sb: 0.5% or less,
with a balance consisting of Fe and inevitable impurities,
wherein, in a hardness distribution in a region from a rail head surface to a depth of 16.0 mm:
a part having higher hardness than V1 is present in a second internal region from 10.0 mm to 16.0 mm in depth located deeper than a first internal region from 4.0 mm to 8.0 mm in depth, where V1 is minimum hardness in the first internal region; and
hardness of the rail head surface is HBW 400 to 520, and average hardness in the region from the rail head surface to the depth of 16.0 mm is HBW 350 or more.

2. The rail according to claim 1 wherein the chemical composition consists of, in mass %,
C: 0.60% to 0.84%,
Si: 0.10% to 1.50%,
Mn: 0.20% to 1.50%,
P: 0.035% or less,
S: 0.035% or less, and
Cr: 0.49% to 2.00%,
with a balance consisting of Fe and inevitable impurities.

3. The rail according to claim 2, wherein a difference between V2 and V1 is HBW 5 or more, where V2 is average hardness in the second internal region.

4. The rail according to claim 3, wherein hardness in the second internal region increases continuously in a depth direction from the rail head surface.

5. The rail according to claim 2, wherein the part having higher hardness than V1 is present throughout the second internal region.

6. The rail according to claim 5, wherein hardness in the second internal region increases continuously in a depth direction from the rail head surface.

7. The rail according to claim 2, wherein hardness in the second internal region increases continuously in a depth direction from the rail head surface.

8. A manufacturing method for the rail according to claim 2, the manufacturing method comprising:
subjecting a steel material having the chemical composition according to claim 2 to hot rolling to obtain a rail;
thereafter cooling the rail from a temperature not less than austenite temperature to a first cooling temperature of A−25° C. to A+25° C., at an average cooling rate of 1° C./s to 20° C./s;
thereafter holding the rail until a temperature of the rail reaches an intermediate temperature of A+30° C. to A+200° C.; and
thereafter cooling the rail at an average cooling rate of 0.5° C./s to 20° C./s for 10 sec or more,
wherein A is a temperature at an intersection point between a pearlite transformation start curve and a bainite transformation start curve in a TTT diagram of steel having the chemical composition, and the temperature of the rail and the average cooling rate are respectively a temperature and an average cooling rate at the rail head surface.

9. The rail according to claim 1, wherein a difference between V2 and V1 is HBW 5 or more, where V2 is average hardness in the second internal region.

10. The rail according to claim 9, wherein hardness in the second internal region increases continuously in a depth direction from the rail head surface.

11. The rail according to claim 9, wherein the part having higher hardness than V1 is present throughout the second internal region.

12. The rail according to claim 11, wherein hardness in the second internal region increases continuously in a depth direction from the rail head surface.

13. The rail according to claim 1, wherein the part having higher hardness than V1 is present throughout the second internal region.

14. The rail according to claim 13, wherein hardness in the second internal region increases continuously in a depth direction from the rail head surface.

15. The rail according to claim 3, wherein the part having higher hardness than V1 is present throughout the second internal region.

16. The rail according to claim 15, wherein hardness in the second internal region increases continuously in a depth direction from the rail head surface.

17. The rail according to claim 1, wherein hardness in the second internal region increases continuously in a depth direction from the rail head surface.

18. A manufacturing method for the rail according to claim 1, the manufacturing method comprising:
subjecting a steel material having the chemical composition according to claim 1 to hot rolling to obtain a rail;
thereafter cooling the rail from a temperature not less than austenite temperature to a first cooling temperature of A−25° C. to A+25° C., at an average cooling rate of 1° C./s to 20° C./s;
thereafter holding the rail until a temperature of the rail reaches an intermediate temperature of A+30° C. to A+200° C.; and
thereafter cooling the rail at an average cooling rate of 0.5° C./s to 20° C./s for 10 sec or more,
wherein A is a temperature at an intersection point between a pearlite transformation start curve and a bainite transformation start curve in a TTT diagram of steel having the chemical composition, and the temperature of the rail and the average cooling rate are respectively a temperature and an average cooling rate at the rail head surface.

* * * * *